US008881561B2

(12) United States Patent
Niehausmeier

(10) Patent No.: US 8,881,561 B2
(45) Date of Patent: Nov. 11, 2014

(54) SECURITY DEVICE FOR A WINDOW HANDLE OR DOOR HANDLE

(71) Applicant: Solarlux Aluminum Systeme GmbH, Bissendorf (DE)

(72) Inventor: Uwe Niehausmeier, Rödinghausen (DE)

(73) Assignee: Solarlux Aluminium Systeme GmbH, Bissendorf (DE)

( * ) Notice: Subject to any disclaimer, the term of this patent is extended or adjusted under 35 U.S.C. 154(b) by 0 days.

(21) Appl. No.: 14/132,116

(22) Filed: Dec. 18, 2013

(65) Prior Publication Data

US 2014/0165668 A1 Jun. 19, 2014

(30) Foreign Application Priority Data

Dec. 19, 2012 (DE) ..... 10 2012 024 798

(51) Int. Cl.
*E05B 13/00* (2006.01)

(52) U.S. Cl.
CPC ..... *E05B 13/001* (2013.01); *Y10S 70/58* (2013.01)
USPC ..... 70/89; 70/91; 70/169; 70/202; 70/208; 70/211; 70/428; 70/455; 70/462; 70/DIG. 58

(58) Field of Classification Search
USPC ..... 70/416, 423–428, 455, 461, 462, 70/DIG. 58, 89, 91, 202, 208, 211, 430, 70/158, 163, 166–173
See application file for complete search history.

(56) References Cited

U.S. PATENT DOCUMENTS

| | | | | | |
|---|---|---|---|---|---|
| 2,134,922 | A | * | 11/1938 | Laing | 70/428 |
| 2,463,195 | A | * | 3/1949 | Mungan | 70/416 |
| 3,141,319 | A | * | 7/1964 | Schlage | 70/81 |
| 3,469,041 | A | * | 9/1969 | Winston | 379/445 |
| 3,563,069 | A | * | 2/1971 | Ferrer | 70/129 |
| 3,563,070 | A | * | 2/1971 | Earl | 70/232 |
| 3,660,996 | A | * | 5/1972 | Syvertson | 70/209 |
| 3,826,117 | A | * | 7/1974 | Racobs | 70/416 |
| 3,866,445 | A | * | 2/1975 | Erwin | 70/428 |
| 3,888,096 | A | * | 6/1975 | Huss | 70/209 |
| 3,939,678 | A | * | 2/1976 | Wagoner | 70/57 |
| 4,012,928 | A | * | 3/1977 | Dauenbaugh | 70/81 |
| 4,064,721 | A | * | 12/1977 | Morgan | 70/416 |
| 4,113,291 | A | * | 9/1978 | Cameron | 292/40 |
| 4,227,388 | A | * | 10/1980 | Nigrelli et al. | 70/427 |
| 4,884,424 | A | * | 12/1989 | Meyer | 70/427 |
| 5,303,971 | A | * | 4/1994 | Johnsen et al. | 296/50 |
| 5,588,316 | A | * | 12/1996 | Jones | 70/178 |
| 5,735,147 | A | * | 4/1998 | Cattanach et al. | 70/164 |

(Continued)

FOREIGN PATENT DOCUMENTS

| | | | |
|---|---|---|---|
| CH | 689 871 | A5 | 12/1999 |
| DE | 195 17 833 | C1 | 8/1996 |

*Primary Examiner* — Lloyd Gall
(74) *Attorney, Agent, or Firm* — Gudrun E. Huckett

(57) ABSTRACT

A security device for a handle of a door or a window for protecting against unauthorized actuation has a cover enclosing in a mounted position the handle. A lock is provided that secures the cover on the handle in the mounted position and releases the cover from the handle for removing the cover from the handle. The cover has at least two locking elements. Counter members are disposed on the handle, a handle fixture, a door, or a window, and are matched and interact with the at least two locking elements. One of the locking elements is a locking bar of the lock.

4 Claims, 7 Drawing Sheets

(56) References Cited

U.S. PATENT DOCUMENTS 5,970,756 A * 10/1999 Miller et al. ..... 70/168
6,105,406 A * 8/2000 Thompson et al. ..... 70/416
6,364,339 B1 * 4/2002 Lee ..... 280/507
6,658,906 B1 * 12/2003 Wright ..... 70/455
7,353,671 B2 * 4/2008 Recknagel et al. ..... 70/34
7,971,459 B2 * 7/2011 Price ..... 70/201
2013/0139563 A1 * 6/2013 Brooks ..... 70/455

* cited by examiner

SECURITY DEVICE FOR A WINDOW HANDLE OR DOOR HANDLE

BACKGROUND OF THE INVENTION

The invention relates to a security device for a window handle or door handle to prevent unauthorized actuation of the handle of the window or door. The security device comprises a cover that covers or encloses the handle and a lock that detachably secures the cover on the handle.

Nowadays, it is customary to door handles or window handles provided with an integrated cylinder lock offer as a break-in protection and/or child safety. However, if the existing handle for the window or door is not to be exchanged or cannot be exchanged for a lockable one, additional blocking devices must be employed.

For example, CH 689 871 A5 discloses a security device of an armored door of shelters wherein a removable cover as well as the handle itself are penetrated by a closure part that is locked subsequently on the exterior of the cover by means of a separate lock. The configuration, as a result of its use for armored doors, is massive and heavy and relatively complex. Its use in connection with doors or windows of living spaces is not practical because there are at least three separate individual parts, i.e., the cover, the closure part, and the armored lock, that are lying around when the device is not in use.

DE 195 17 833 C1 discloses securing a handle for doors or windows against unauthorized actuation by means of two cover caps that are matched by means of adjusting screws to the height of the handle and are secured by the screws and, if desired, can be locked by a cylinder lock. The adaptation and fixation of this device is also complex. Also, there are again several parts that must be stowed away when the device is not in use.

In practice, it has been found that there is a need for handle-mounted security devices particularly for so-called flat handles that are used, for example, in connection with folding door/window systems where folding of the individual door/window elements and their minimal spacing in the folded state does not allow for the use of door or window handles of regular size/height. Usually, such flat handles also do not permit installation of locks directly in the handles as is possible in regular closeable or lockable door or window handles. For securing such flat handles, up to now the prior art has not arrived at any solution that does not only fulfill the security aspect but is also visually unobtrusive.

SUMMARY OF THE INVENTION

It is an object of the present invention to provide a security device of the aforementioned kind for handles of doors or windows that prevents in a simple way unauthorized actuation and can be stowed away easily when not in use.

In accordance with the present invention, this is achieved in that the security device has at least two locking elements that interact with matching counter members arranged on the handle, the handle cover plate or fixture, and/or the window or door wherein one of the locking elements is a locking bar of the lock.

By designing the cover with at least two locking elements which interact with matching counter elements on the handle, the cover plate, and/or the window or door, and by configuring at least one of these locking elements as a locking bar of a lock that is integrated into the cover, the securing device requires only one single removable part, i.e., the cover that therefore can be designed to be appropriately slim and flat. Because the lock, in particular a cylinder lock, is received within the cover, the security device does not interfere with the requirements of minimal height of the handle in case of folding door/window systems because the cover inclusive of the lock can be removed when such a folding door/window device is opened and moved into the folded position.

A preferred fixed connection of the lock with the cover ensures that no individual parts that could be lost when the security device is not in use are lying around. For a proper and secure attachment of the security device it is advantageous when one of the counter members interacting with the locking elements is a lock plate that is fixedly connected with the window or the door. In a further preferred embodiment, the locking bar of the lock and/or its counter member can have a ramp and at least one of these two parts can be spring-loaded in the direction toward the other so that it can yield and move against the spring force of the spring. This makes it possible to attach the cover to the handle even when the cylinder lock is locked because the locking bar of the lock or its counter part is then pushed back by the ramp and, at the end of the ramp, is then pushed back and returned into its initial position by the spring tension of the spring to ensure the fixed connection. In this configuration, the lock must be actively unlocked only for opening the security device.

In a further preferred embodiment, the counter members interacting with the two locking elements are arranged on the window or the door opposite each other and have identical function, i.e., they are functionally symmetrically shaped, so that the cover, if needed, can be rotated by 180° and attached. When the lock is on one end of the cover, the user can then freely select whether the lock is to be positioned at the bottom or at the top.

With the simple configuration of the present invention in which the important elements are integrated into the cover, a slim configuration with a pleasing appearance can be realized that does not cause the attached security device according to the invention to visually stand out or be noticeable. Still, the system is safe and easy to use.

BRIEF DESCRIPTION OF THE DRAWING

Further advantages and details result from the dependent claims and an embodiment illustrated in the drawings to be explained in the following.

DESCRIPTION OF THE PREFERRED EMBODIMENTS

Figure 1A:
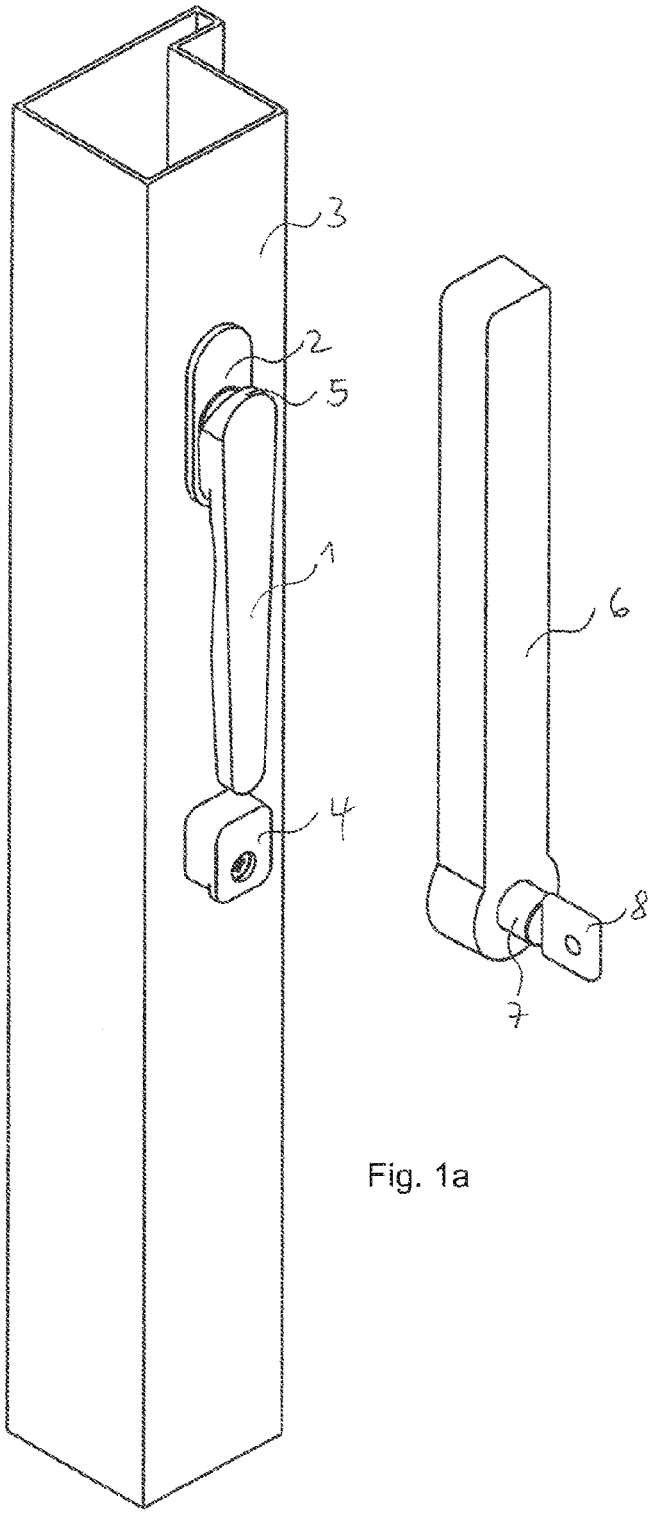
FIG. 1*a* shows the security device according to the invention with removed cover in a perspective view and FIG. 1*b* shows a section view without cover.
Figure 1B:
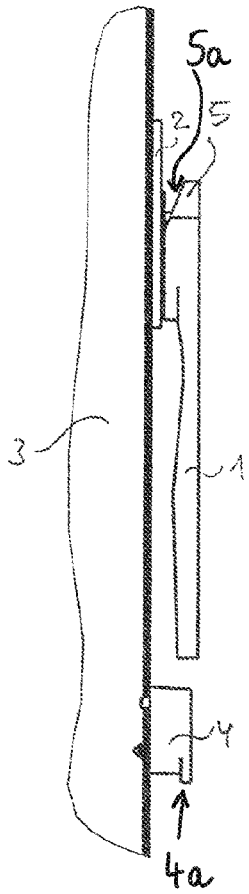

FIG. 1*a* shows a flat handle 1 mounted with a cover plate 2 on a frame element 3 or a window or a door. Below the handle 1, a counter member in the form of a lock plate 4 is screwed onto the frame element 3; this lock plate 4 interacts with locking elements, illustrated in the following Figures, of a cover 6 of the security device that is not yet attached in the view of FIGS. 1*a*, 1*b*. A further counter member 5 is in the form of the upper end of the handle 1 that is provided in any case with a slanted portion 5*a* so as to enable tilting of the handle and this slanted portion 5*a* can be engaged as a functional part of the counter member by a locking element. The cover 6 comprises a cylinder lock 7 to be actuated by key 8.

Figure 2A:
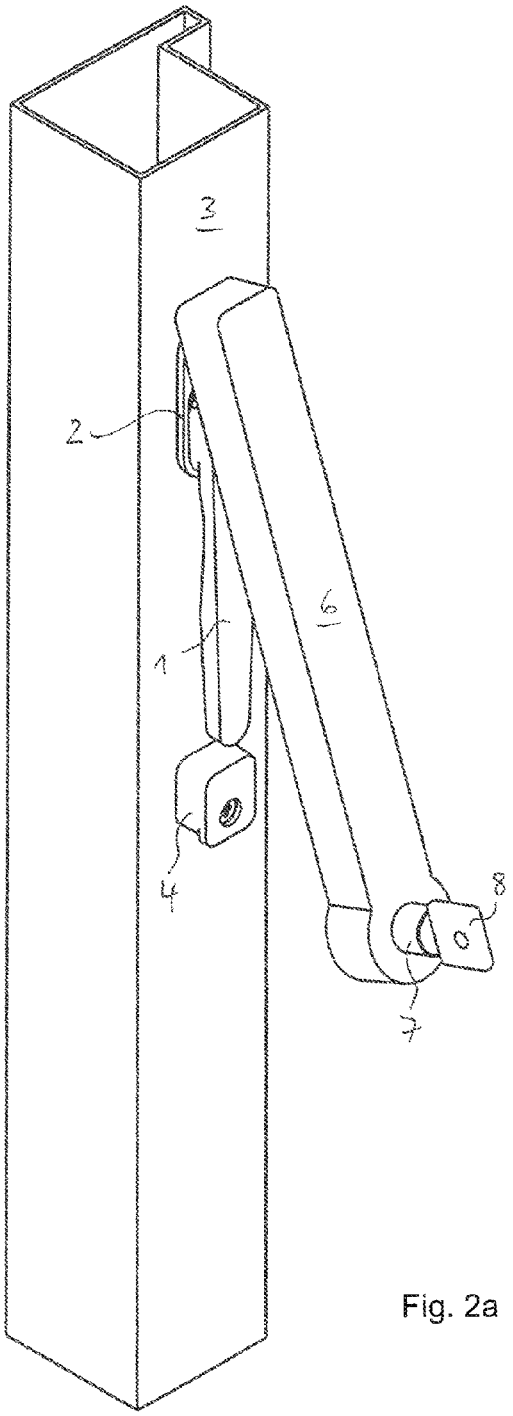
FIG. 2*a* shows the object of FIG. 1*a* with the cover in the process of being attached.
Figure 2B:
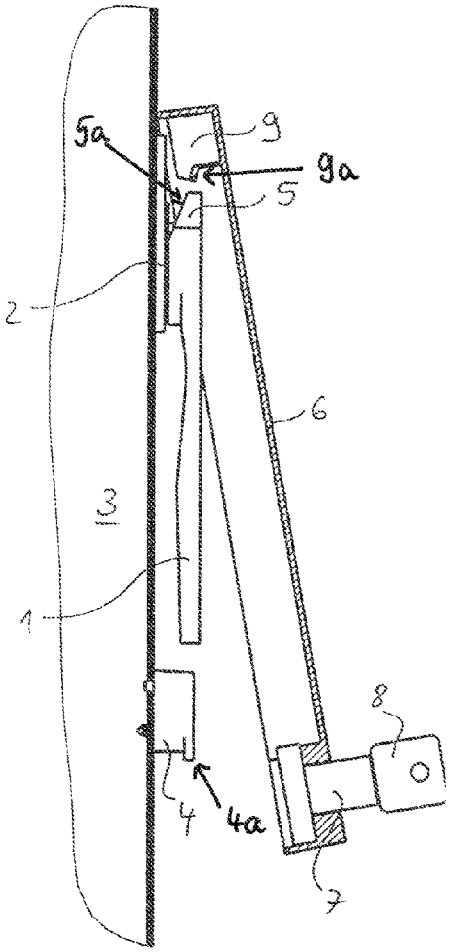
FIG. 2*b* shows a section view.
Figure 3A:
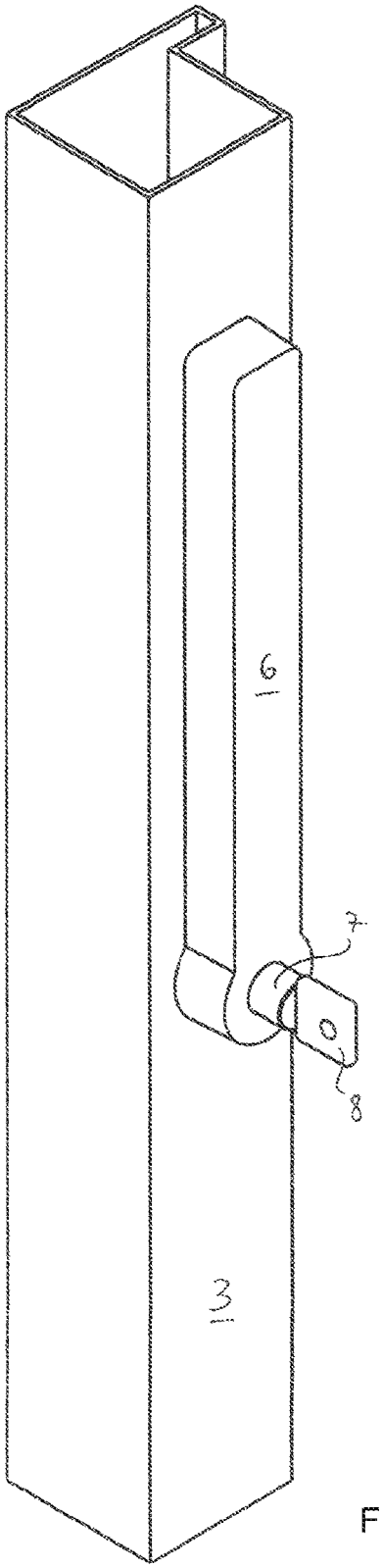
FIG. 3*a* shows the object of the preceding figures with cover attached but not yet locked in perspective view.

FIG. 2*a* shows the situation in which the cover 6 has been placed over the flat handle 1. In doing so, the locking element 9, arranged at the inner side at the upper end of the cover 6, engages with a projection 9*a* the counter member 5 that is formed by the upper end of the handle 1. The lock 7 is open, i.e. the locking bar, not visible here, is in the position "open" or "retracted". Accordingly, the cover 6 can be placed flat with its lower end onto the frame element 3, as illustrated in FIGS. 3*a* and 3*b*.

Figure 3B:
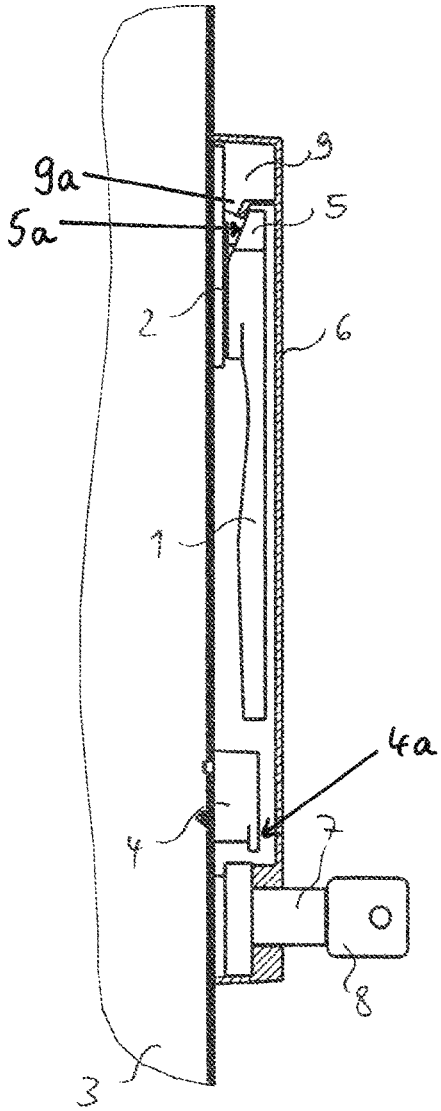
FIG. 3*b* shows a section view.
Figure 4A:
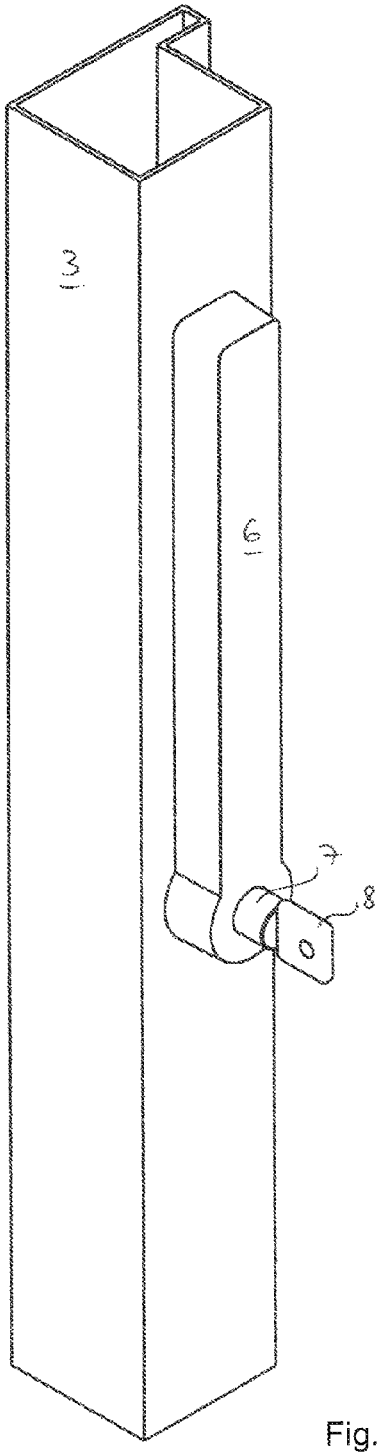
FIG. 4*a* shows the object of FIG. 3*a* in locked position.
Figure 4B:
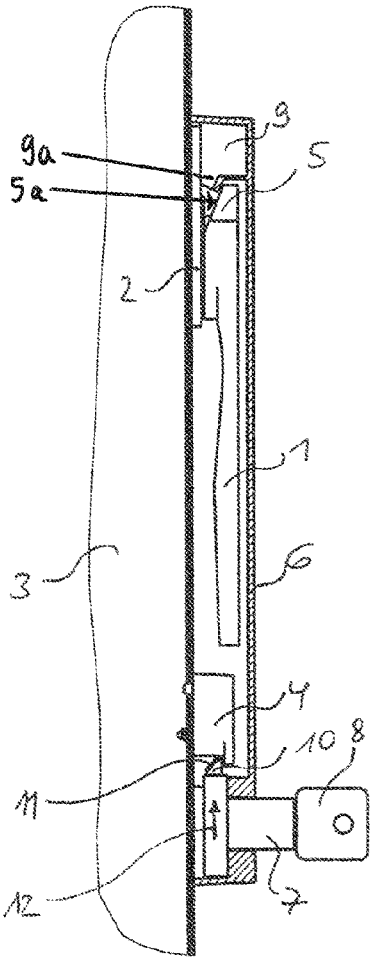
FIG. 4*b* shows a section view.

FIG. 4*b* shows how the now visible locking bar 10 of the lock 7, by having turned the key 8 by 180°, is moved from the position "open" or "retracted" of FIG. 3*b* into the position "closed" or "extended" in FIG. 4*b*. The locking bar 10 represents the second locking element and engages a projection 4*a* as a functional part of the counter member 4. When the locking bar 10, as illustrated, has a ramp 11 and is spring-loaded (not visible) in the direction of arrow 12, mounting of the cover 6 can also be realized when the lock 7 is locked. In this case, the previously extended (locked) locking bar 10 is automatically moved into the position "open" or "retracted" when the cover 6 is placed onto the flat handle 1 and the locking bar 10 contacts the counter member 4; when the end of the ramp 11 is reached, the locking bar 10 is restored by the spring action into the position "closed" or "extended" as illustrated in FIG. 4*b*.

Figure 5A:
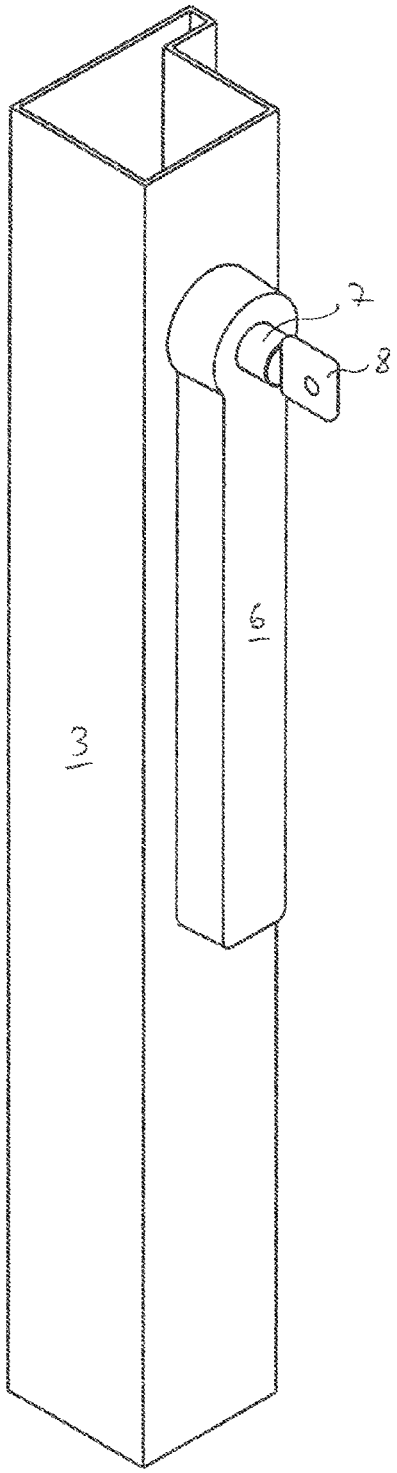
FIG. 5*a* shows the object of FIG. 4*a* with the cover attached in rotated position.
Figure 5B:
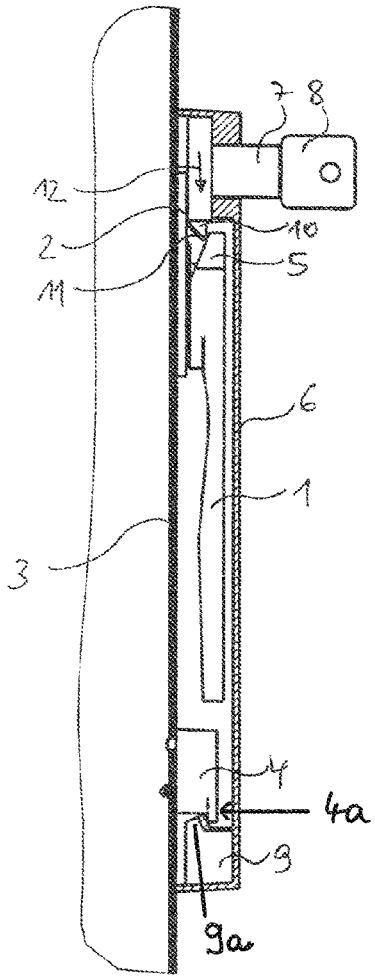
FIG. 5*b* shows a section view.
Figure 6A:
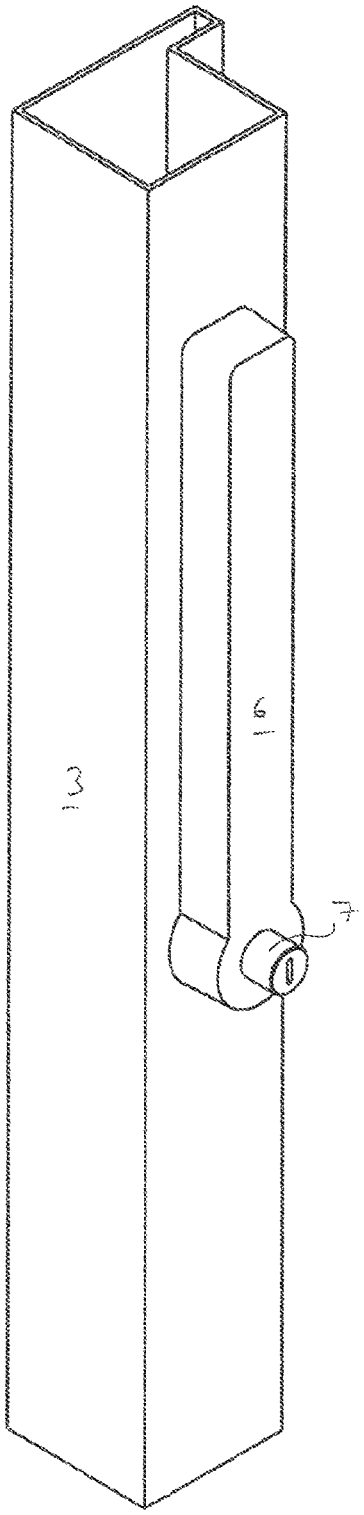
FIG. 6*a* shows the cover of FIG. 4*a* with key removed.
Figure 6B:
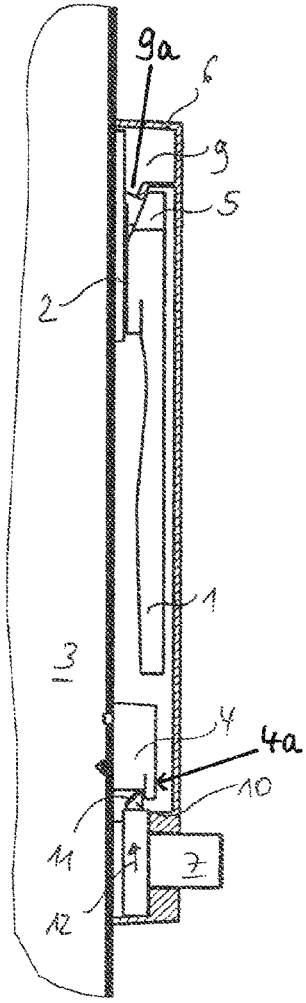
FIG. 6*b* shows a section view.
Figure 7A:
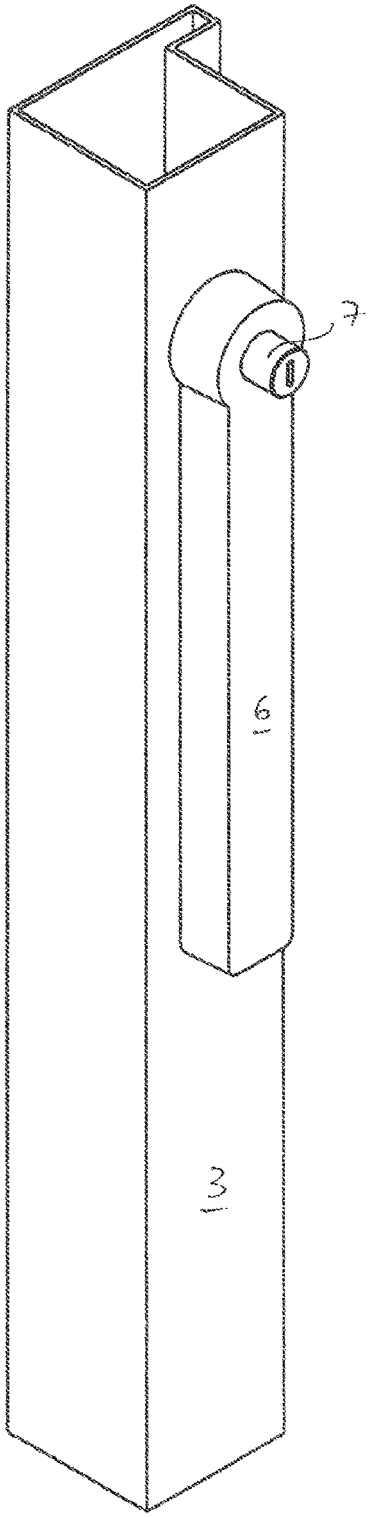
FIG. 7*a* shows the object of FIG. 5*a* with key removed.
Figure 7B:
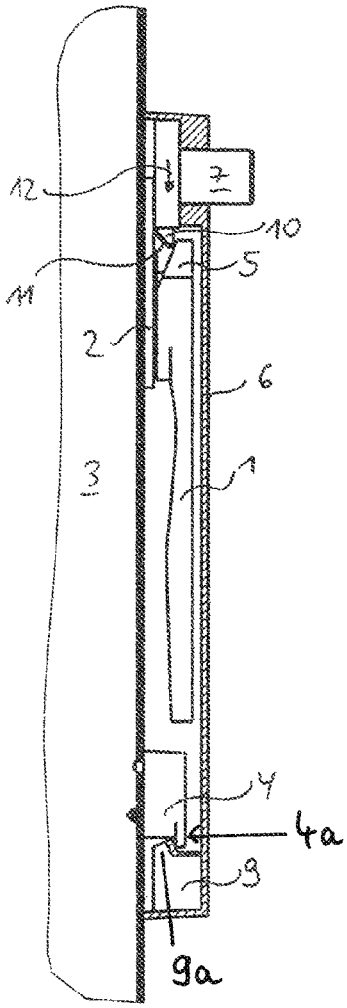
FIG. 7*b* shows a section view.

FIGS. 5*a* and 5*b* show that the cover 6 of the illustrated preferred embodiment can also be placed in a position rotated by 180° onto the handle, if desired, because the two counter members 4, 5 are arranged opposite each other relative to the frame element 3 and the locking elements; even though the counter members 4, 5 are not identical, they have functionally the same shape due to the appropriate projections or undercuts. Accordingly, the position of the cover 6 with lock 7 at the bottom or lock 7 at the top relative to the frame element 3 can be freely selected for maximum comfort, for example, depending on how tall the person is who is positioning the cover on the handle.

For completeness, FIGS. 6*a*, 6*b* and 7*a*, 7*b* show the security device with removed key; in this state, the security device fulfills the function of an access prevention means or actuating barrier.

In a variant of the cover 6 of FIGS. 5*a*, 5*b* and 7*a*, 7*b* the lower locking element can be designed, as an alternative embodiment (not illustrated), as a projection of the cover 6 (instead of the element 9) that engages a counter member formed as a recess in the window or the door or the frame element 3.

The security device according to the invention can be handled easily and can be retrofitted due to the possibility of mounting the counter member 4 at a later point in time on the frame element 3. When the handle 1 is designed differently at the upper end and therefore cannot form the counter member 5, the counter member can be formed, for example, by lateral and upper flanks of the cover plate or fixture 2 which, with a precise fit configuration, can interact with the inner walls of the cover 6 and in this way prevent rotation of the cover together with the handle 1.

The specification incorporates by reference the entire disclosure of German priority document 10 2012 024 798.2 having a filing date of Dec. 19, 2012.

While specific embodiments of the invention have been shown and described in detail to illustrate the inventive principles, it will be understood that the invention may be embodied otherwise without departing from such principles.

What is claimed is:

1. A security device for a handle of a door or a window for protecting against unauthorized actuation, the security device comprising:

a handle adapted to be connected to a frame element of a door or a window;

a cover adapted to attach to the handle in a mounted position and enclose the handle in the mounted position;

the cover provided with a first locking element and a second locking element;

a lock connected to the cover and adapted to secure the cover on the handle in the mounted position and to release the cover from the handle for removing the cover from the handle;

a first counter member disposed on the handle or on a cover plate of the handle;

a second counter member adapted to be connected to the frame element;

the first locking element adapted to engage the first counter member and the second locking element adapted to engage the second counter member in the mounted position;

wherein one of the first and second locking elements is a locking bar of the lock;

wherein the first and second counter members each have a functional part engaged by the first and second locking elements, respectively, and the functional parts are facing away from each other, wherein the first and second locking elements are positioned at opposed ends of the cover so that the cover is adapted to engage the first and second counter members in a first position or in a second position, rotated by 180 degrees relative to the first position.

2. The security device according to claim 1, wherein the lock is fixedly connected to the cover.

3. The security device according to claim 1, wherein at least one of the counter members is a lock plate fixedly connected to the window or the door.

4. The security device according to claim 1, wherein at least one of the locking bar and the counter member that is interacting with the locking bar has a ramp and wherein at least one of the locking bar and the counter member that is interacting with the locking bar is spring-loaded by a spring force and moveable against the spring force.

* * * * *